US011634269B1

(12) United States Patent
LaSalle

(10) Patent No.: US 11,634,269 B1
(45) Date of Patent: Apr. 25, 2023

(54) SPRAY FOAM INSULATOR ASSEMBLY

(71) Applicant: Daniel LaSalle, Brockville (CA)

(72) Inventor: Daniel LaSalle, Brockville (CA)

( * ) Notice: Subject to any disclaimer, the term of this patent is extended or adjusted under 35 U.S.C. 154(b) by 0 days.

(21) Appl. No.: 17/678,719

(22) Filed: Feb. 23, 2022

(51) Int. Cl.
*A45F 5/02* (2006.01)
*B65D 83/38* (2006.01)
*B65D 81/38* (2006.01)

(52) U.S. Cl.
CPC ..... *B65D 83/384* (2013.01); *A45F 5/021* (2013.01); *B65D 81/3879* (2013.01)

(58) Field of Classification Search
CPC ..... A45F 5/021; A45F 2200/0583; A45F 2200/0566; B65D 83/384; B65D 81/3879
USPC ..... 224/677, 148.3
See application file for complete search history.

(56) References Cited

U.S. PATENT DOCUMENTS 3,036,717 A * 5/1962 Johnson ..... A47G 23/0225 224/482
4,401,245 A * 8/1983 Zills ..... B65D 81/3886 224/148.6
4,871,597 A * 10/1989 Hobson ..... B32B 27/065 220/903
5,232,137 A * 8/1993 Devine ..... A45F 5/02 224/678
5,325,991 A * 7/1994 Williams ..... A47G 23/0225 224/543
5,680,958 A 10/1997 Mann
5,865,412 A * 2/1999 Mason ..... A47C 7/62 248/300
5,915,580 A * 6/1999 Melk ..... B65D 81/3886 220/592.24
6,457,616 B2 * 10/2002 Gagne ..... A45F 5/02 224/148.7
8,919,622 B1 * 12/2014 Gabriel ..... A45F 5/021 224/159
9,578,954 B2 2/2017 Sellars
10,173,827 B1 * 1/2019 Foote, Jr. ..... A47G 23/0241
11,364,171 B2 * 6/2022 Brockway ..... A61H 3/00
2009/0255941 A1 * 10/2009 Kuntz ..... B65D 81/3879 220/592.17
2010/0294816 A1 * 11/2010 Sentell ..... A45F 5/02 224/148.3
2014/0339240 A1 11/2014 Moore
2015/0096995 A1 4/2015 Cunningham
(Continued)

FOREIGN PATENT DOCUMENTS

WO WO2019161440 8/2019

*Primary Examiner* — Adam J Waggenspack

(57) ABSTRACT

A spray foam insulator assembly for retaining a pressurized can of spray foam at a preferred temperature includes an insulating sleeve that has a diameter of at least 68.0 mm and a height of at least 245.0 mm to insertably receive a pressurized can of spray foam. The insulating sleeve is comprised of a thermally insulating material to retain the pressurized can of spray foam at an optimal temperature for enhancing functionality of the pressurized can of spray foam. The insulating sleeve has a cut integrated into the insulating sleeve to enhance inserting the pressurized can of spray foam into the insulating sleeve. A closure is integrated into the insulating sleeve for opening and closing the cut. A belt clip is coupled to the insulating sleeve to engage an article of clothing on a user for storing the insulating sleeve.

8 Claims, 5 Drawing Sheets

(56) References Cited

U.S. PATENT DOCUMENTS

| | | | |
|---|---|---|---|
| 2020/0390258 | A1 | 12/2020 | Randall |
| 2021/0052096 | A1 | 2/2021 | Leatherman |

* cited by examiner

SPRAY FOAM INSULATOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to insulator device and more particularly pertains to a new insulator device for retaining a pressurized can of spray foam at a preferred temperature. The device includes an insulating sleeve which has a cut to spread the insulating sleeve to enhance inserting a pressurized can of spray foam into the insulating sleeve. The device includes a closure for opening or closing the cut. The device includes an elastomeric band which is biased to compress against the pressurized can of spray foam. Additionally, the device includes a belt clip attached to the insulating sleeve for attaching the insulating sleeve to an article of clothing.

(2) Description of Related Art Including Information Disclosed Under 37 CFR 1.97 and 1.98

The prior art relates to insulator devices including an insulated bottle holder which includes a belt for wearing on a user. The prior art discloses an insulating sleeve for containing a beverage container that includes a removable belt clip. The prior art discloses an insulated sleeve that includes a cut for spreading the insulating sleeve and a flap that is foldable over the insulating sleeve. The prior art discloses a beverage container system that includes a beverage bottle and an insulated sleeve that insertably receives the beverage bottle. The prior art discloses a drinking vessel holder that includes an insulating sleeve, a cut integrated into the insulating sleeve for spreading the insulating sleeve and a closure for closing the cut. The prior art discloses a drinking container holder that includes an insulating sleeve which has a lip folded over a top end of the insulating sleeve and a closure for opening or closing the insulating sleeve.

BRIEF SUMMARY OF THE INVENTION

An embodiment of the disclosure meets the needs presented above by generally comprising an insulating sleeve that has a diameter of at least 68.0 mm and a height of at least 245.0 mm to insertably receive a pressurized can of spray foam. The insulating sleeve is comprised of a thermally insulating material to retain the pressurized can of spray foam at an optimal temperature for enhancing functionality of the pressurized can of spray foam. The insulating sleeve has a cut integrated into the insulating sleeve to enhance inserting the pressurized can of spray foam into the insulating sleeve. A closure is integrated into the insulating sleeve for opening and closing the cut. A belt clip is coupled to the insulating sleeve to engage an article of clothing on a user for storing the insulating sleeve.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
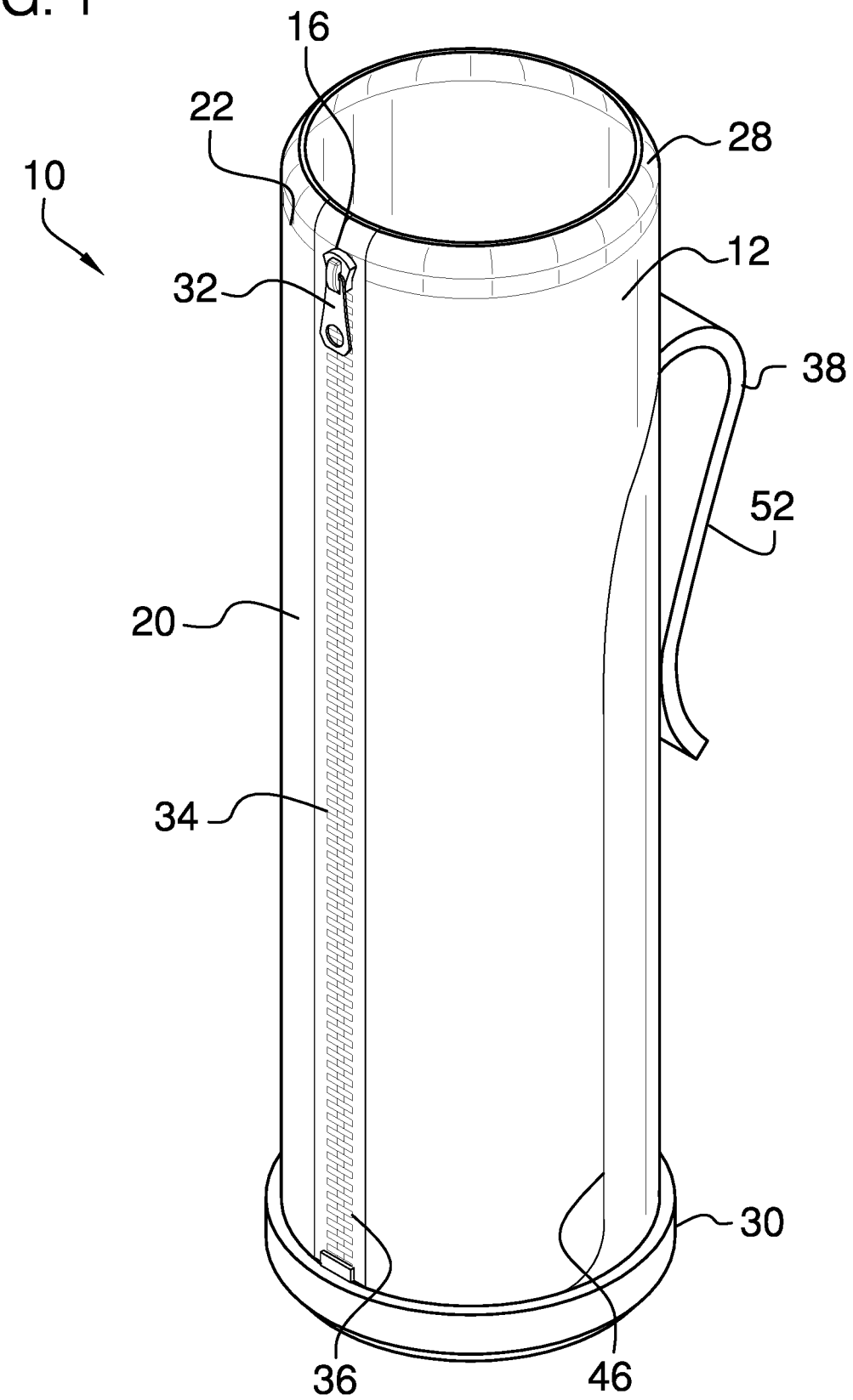
FIG. 1 is a top perspective view of a spray foam insulator assembly according to an embodiment of the disclosure.
Figure 2:
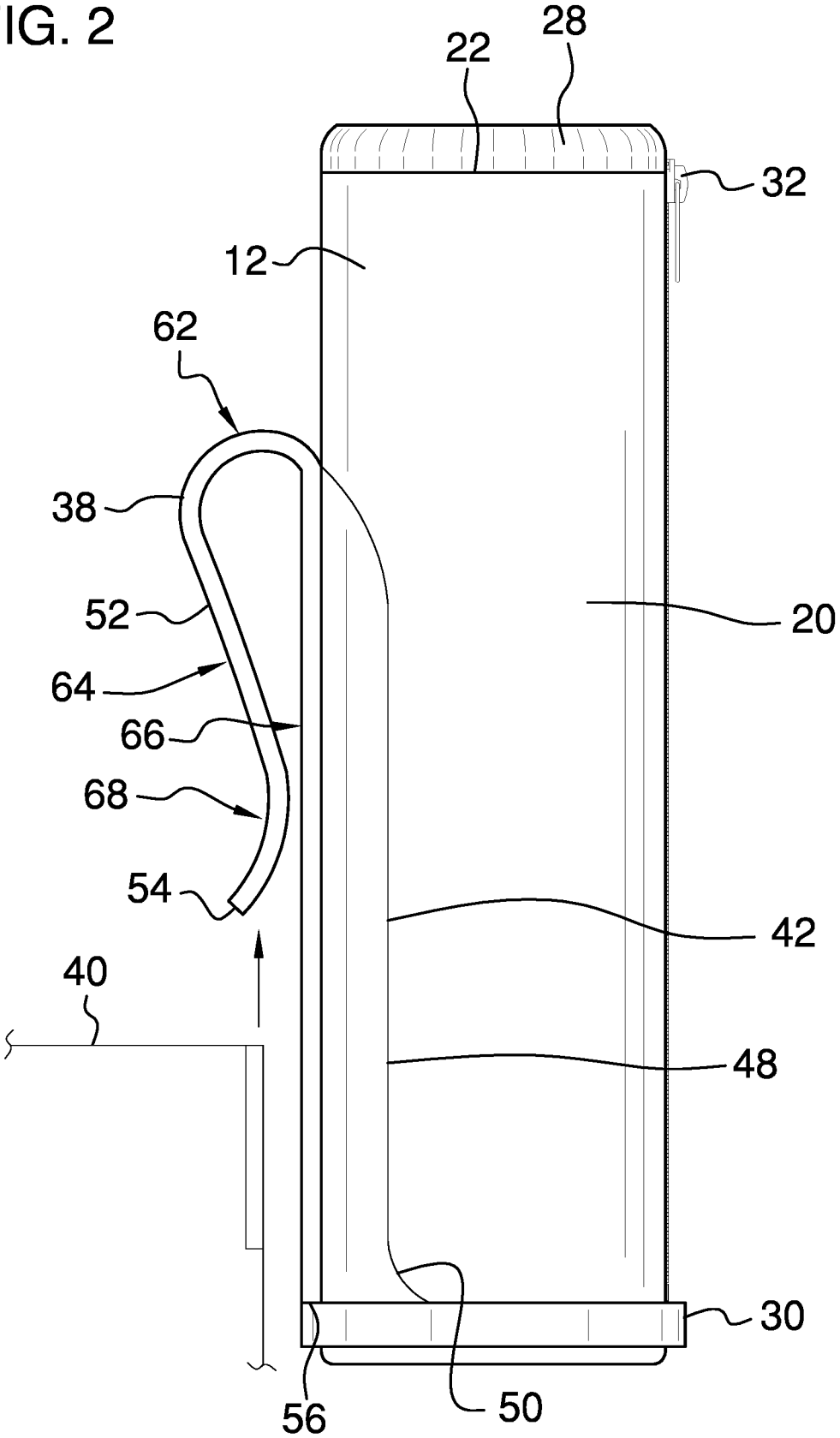
FIG. 2 is a right side view of an embodiment of the disclosure.
Figure 3:
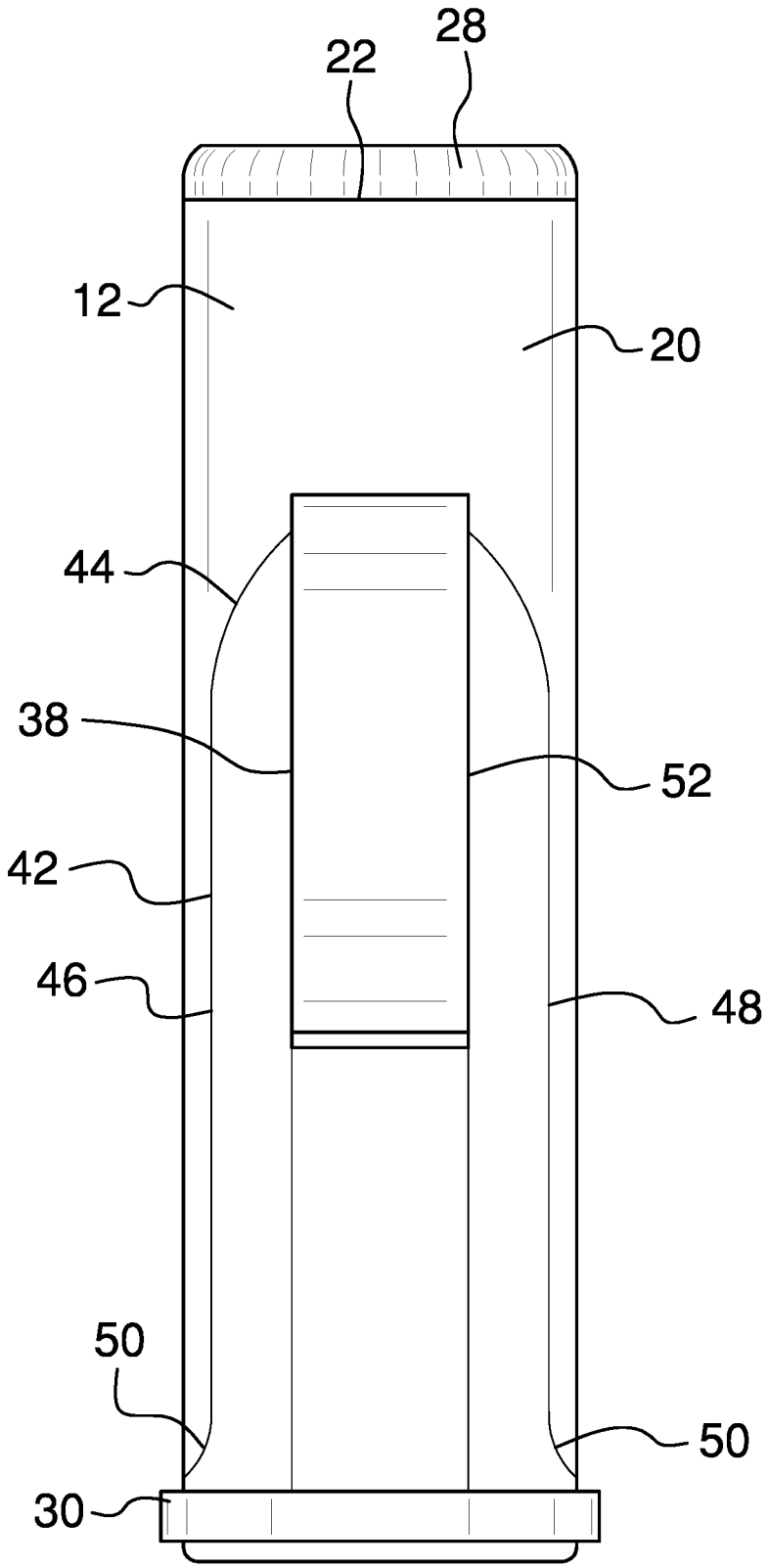
FIG. 3 is a back side view of an embodiment of the disclosure.
Figure 4:
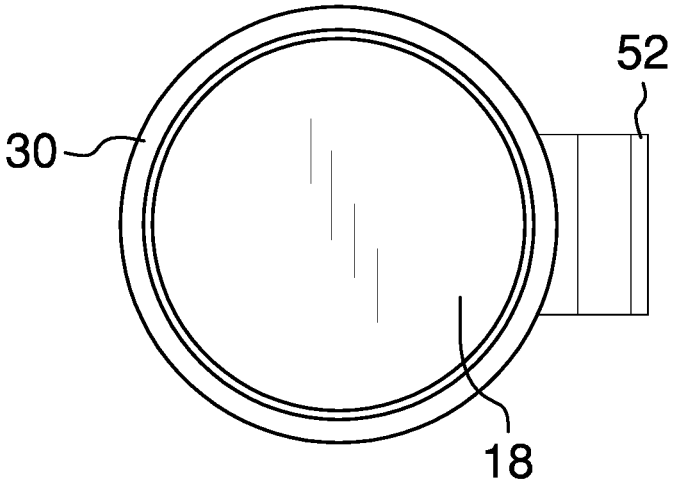
FIG. 4 is a bottom view of an embodiment of the disclosure.
Figure 5:
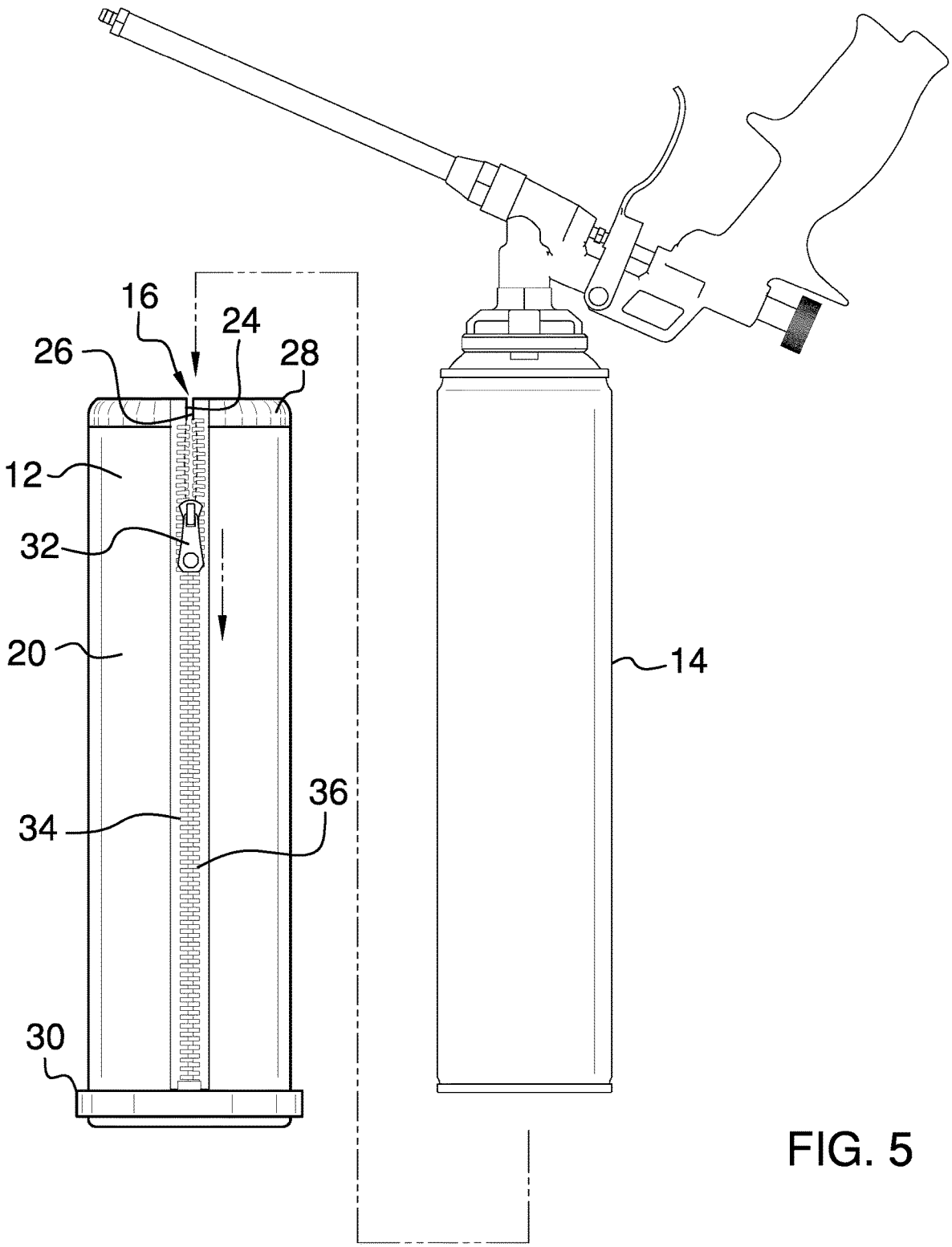
FIG. 5 is an exploded in-use view of an embodiment of the disclosure.

With reference now to the drawings, and in particular to FIGS. 1 through 5 thereof, a new insulator device embodying the principles and concepts of an embodiment of the disclosure and generally designated by the reference numeral 10 will be described.

As best illustrated in FIGS. 1 through 5, the spray foam insulator assembly 10 generally comprises an insulating sleeve 12 which has a diameter of at least 68.0 mm and a height of at least 245.0 mm to insertably receive a pressurized can of spray foam 14. The pressurized can of spray foam 14 may contain expanding foam that is commonly employed for insulating cracks between windows, doors and a building. The insulating sleeve 12 is comprised of a thermally insulating material, including but not being limited to neoprene, to retain the pressurized can of spray foam 14 at an optimal temperature for enhancing functionality of the pressurized can of spray foam 14. The insulating sleeve 12 has a cut 16 integrated into the insulating sleeve 12 to facilitate the insulating sleeve 12 to be spread open. In this way the insulating sleeve 12 enhances inserting the pressurized can of spray foam 14 into the insulating sleeve 12.

The insulating sleeve 12 has a bottom wall 18 and a perimeter wall 20 extending upwardly from the bottom wall 18, and the perimeter wall 20 has a distal edge 22 with respect to the bottom wall 18. The cut 16 extends through the perimeter wall 20 and the cut 16 extends from the distal edge 22 toward the bottom wall 18, and the cut 16 has a first bounding edge 24 and a second bounding edge 26. An elastomeric band 28 is coupled to and extends around a full circumference of the distal edge 22 of the perimeter wall 20 of the insulating sleeve 12. In this way the elastomeric band 28 is biased to compress against the pressurized can of spray foam 14 for retaining the pressurized can of spray foam 14 within the insulating sleeve 12. A ring 30 is bonded to the insulating sleeve 12 and the ring 30 is comprised of a rigid material thereby facilitating the ring 30 to enhance structural rigidity of the insulating sleeve 12. The ring 30 extends around a full circumference of the perimeter wall 20 of the insulating sleeve 12. Furthermore, the ring 30 is positioned adjacent to the bottom wall 18 of the insulating sleeve 12.

A closure 32 is integrated into the insulating sleeve 12 and the closure 32 is aligned with the cut 16 for opening and closing the cut 16. The closure 32 comprises a first portion 34 extending along the first bounding edge 24 of the cut 16. Additionally, the closure 32 comprises a second portion 36 extending along the second bounding edge 26 of the cut 16. The first portion 34 engages the second portion 36 when the closure 32 is manipulated into a closing condition. Conversely, the first portion 34 disengages the second portion 36 when the closure 32 is manipulated into an opening condition.

A belt clip 38 is coupled to the insulating sleeve 12 to engage an article of clothing 40 on a user for storing 30 the insulating sleeve 12. The belt clip 38 comprises a panel 42 that is integrated into the perimeter wall 20 of the insulating sleeve 12. The panel 42 extends from the ring 30 toward the distal edge 22 of the perimeter wall 20, and the panel 42 has an upper edge 44, a first lateral edge 46 and a second lateral edge 48. The upper edge 44 curves upwardly between the first lateral edge 46 and the second lateral edge 48, and each of the first lateral edge 46 and the second lateral edge 48 has a curved portion 50 located adjacent to the ring 30. The curved portion 50 of each of the first lateral edge 46 and the second lateral edge 48 curves outwardly from a center of the panel 42.

The belt clip 38 includes a member 52 that has a first end 54, a second end 56 and an outer surface 58 extending between the first end 54 and the second end 56, and the outer surface 58 has a first side 60. The member 52 has a first curve 62 that is positioned closer to the first end 54 than the second end 56 to define a first section 64 of the member 52 extending downwardly along a second section 66 of the member 52. The first end 54 is associated with the first section 64 and the second end 56 is associated with the second section 66. The first side 60 of the outer surface 58 corresponding to the second section 66 is bonded to the panel 42 having the second section 66 being vertically oriented on the panel 42 such that the second end 56 abuts the ring 30. The member 52 has a second curve 68 that is positioned adjacent to the first end 54 such that the first end 54 is directed away from the second section 66. In this way the member 52 facilitates the article of clothing 40 to be inserted between the first section 64 and the second section 66.

In use, the closure 32 is manipulated into the opening condition and the pressurized can of spray foam 14 is inserted into the insulating sleeve 12. The closure 32 is manipulated into the closing condition to secure the pressurized can of spray foam 14 in the insulating sleeve 12. In this way the pressurized can of spray foam 14 can be employed outdoors during winter months while maintaining the pressurized can of spray foam 14 at a sufficiently warm temperature. Thus, the pressurized can of spray foam 14 will continue to function normally as opposed to having reduced output that typically occurs when pressured cans of spray foam are exposed to temperatures that are below 40.0 degrees Fahrenheit. Furthermore, the belt clip 38 can be engaged to an article of clothing 40, such a belt or waist band of pants, for storing the insulating sleeve 12 and the pressurized can of spray foam 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A spray foam insulator assembly for keeping a can of spray foam at a warmed temperature for enhancing functionality of the can of spray foam, said assembly comprising:

an insulating sleeve having a diameter of at least 68.0 mm and a height of at least 245.0 mm wherein said insulating sleeve is configured to insertably receive a pressurized can of spray foam, said insulating sleeve being comprised of a thermally insulating material wherein said insulating sleeve is configured to retain the pressurized can of spray foam at an optimal temperature for enhancing functionality of the pressurized can of spray foam, said insulating sleeve having a cut integrated into said insulating sleeve to facilitate said insulating sleeve to be spread open wherein said insulating sleeve is configured to enhance inserting the pressurized can of spray foam into said insulating sleeve;

a ring being bonded to said insulating sleeve, said ring being comprised of a rigid material thereby facilitating said ring to enhance structural rigidity of said insulating sleeve;

a closure being integrated into said insulating sleeve, said closure being aligned with said cut for opening and closing said cut; and a belt clip being coupled to said insulating sleeve wherein said belt clip is configured to engage an article of clothing on a user for storing said insulating sleeve said insulating sleeve has a bottom wall and a perimeter wall extending upwardly from said bottom wall, said perimeter wall having a distal edge with respect to said bottom wall, said cut extending through said perimeter wall, said cut extending from said distal edge toward said bottom wall, said cut having a first bounding edge and a second bounding edge; and said assembly includes an elastomeric band being coupled to and extending around a full circumference of said distal edge of said perimeter wall of said insulating sleeve wherein said elastomeric band is configured to compress against the pressurized can of spray foam for retaining the pressurized can of spray foam within said insulating sleeve; wherein said ring extending around a full circumference of said perimeter wall of said insulating sleeve, said ring being positioned adjacent to said bottom wall of said insulating sleeve; wherein said belt clip comprises a panel being integrated into said perimeter wall of said insulating sleeve, said panel extending from said ring toward said distal edge of said perimeter wall, said panel having an upper edge, a first lateral edge and a second lateral edge, said upper edge curving upwardly between said first lateral edge and said second lateral edge, each of said first lateral edge and said second lateral edge having a curved portion located adjacent to said ring, said curved portion of each of said first lateral edge and said second lateral edge curving outwardly from a center of said panel.

2. The assembly according to claim 1, wherein said closure comprises a first portion extending along said first bounding edge of said cut, said closure comprising a second portion extending along said second bounding edge of said cut, said first portion engaging said second portion when said closure is manipulated into a closing condition, said first portion disengaging said second portion when said closure is manipulated into an opening condition.

3. The assembly according to claim 1, wherein said belt clip comprises a member having a first end, a second end and an outer surface extending between said first end and said second end, said outer surface having a first side, said first side being bonded to said panel.

4. The assembly according to claim 3, wherein said member has a first curve being positioned closer to said first end than said second end to define a first section of said member extending downwardly along a second section of said member, said first end being associated with said first section, said second end being associated with said second section.

5. The assembly according to claim 4, wherein said first side of said outer surface corresponding to said second section is bonded to said panel having said second section being vertically oriented on said panel, said second end abutting said ring.

6. The assembly according to claim 5, wherein said member has a second curve being positioned adjacent to said first end such that said first end is directed away from said second section wherein said member is configured to have the article of clothing inserted between said first section and said second section.

7. A spray foam insulator assembly for keeping a can of spray foam at a warmed temperature for enhancing functionality of the can of spray foam, said assembly comprising:

an insulating sleeve having a diameter of at least 68.0 mm and a height of at least 245.0 mm wherein said insulating sleeve is configured to insertably receive a pressurized can of spray foam, said insulating sleeve being comprised of a thermally insulating material wherein said insulating sleeve is configured to retain the pressurized can of spray foam at an optimal temperature for enhancing functionality of the pressurized can of spray foam, said insulating sleeve having a cut integrated into said insulating sleeve to facilitate said insulating sleeve to be spread open wherein said insulating sleeve is configured to enhance inserting the pressurized can of spray foam into said insulating sleeve, said insulating sleeve having a bottom wall and a perimeter wall extending upwardly from said bottom wall, said perimeter wall having a distal edge with respect to said bottom wall, said cut extending through said perimeter wall, said cut extending from said distal edge toward said bottom wall, said cut having a first bounding edge and a second bounding edge;

an elastomeric band being coupled to and extending around a full circumference of said distal edge of said perimeter wall of said insulating sleeve wherein said elastomeric band is configured to compress against the pressurized can of spray foam for retaining the pressurized can of spray foam within said insulating sleeve;

a ring being bonded to said insulating sleeve, said ring being comprised of a rigid material thereby facilitating said ring to enhance structural rigidity of said insulating sleeve, said ring extending around a full circumference of said perimeter wall of said insulating sleeve, said ring being positioned adjacent to said bottom wall of said insulating sleeve;

a closure being integrated into said insulating sleeve, said closure being aligned with said cut for opening and closing said cut, said closure comprising a first portion extending along said first bounding edge of said cut, said closure comprising a second portion extending along said second bounding edge of said cut, said first portion engaging said second portion when said closure is manipulated into a closing condition, said first portion disengaging said second portion when said closure is manipulated into an opening condition; and a belt clip being coupled to said insulating sleeve wherein said belt clip is configured to engage an article of clothing on a user for storing said insulating sleeve, said belt clip comprising:

a panel being integrated into said perimeter wall of said insulating sleeve, said panel extending from said ring toward said distal edge of said perimeter wall, said panel having an upper edge, a first lateral edge and a second lateral edge, said upper edge curving upwardly between said first lateral edge and said second lateral edge, each of said first lateral edge and said second lateral edge having a curved portion located adjacent to said ring, said curved portion of each of said first lateral edge and said second lateral edge curving outwardly from a center of said panel; and a member having a first end, a second end and an outer surface extending between said first end and said second end, said outer surface having a first side, said member having a first curve being positioned closer to said first end than said second end to define a first section of said member extending downwardly along a second section of said member, said first end being associated with said first section, said second end being associated with said second section, said first side of said outer surface corresponding to said second section being bonded to said panel having said second section being vertically oriented on said panel, said second end abutting said ring, said member having a second curve being positioned adjacent to said first end such that said first end is directed away from said second section wherein said member is configured to have the article of clothing inserted between said first section and said second section.

8. A spray foam insulator system for keeping a can of spray foam at a warmed temperature for enhancing functionality of the can of spray foam, said assembly comprising:

a pressurized can of spray foam;

an insulating sleeve having a diameter of at least 68.0 mm and a height of at least 245.0 mm to accommodate dimensions of said pressurized can of spray foam, said insulating sleeve being comprised of a thermally insulating material to retain said pressurized can of spray foam at an optimal temperature for enhancing functionality of said pressurized can of spray foam, said insulating sleeve having a cut integrated into said insulating sleeve to facilitate said insulating sleeve to be spread open to enhance inserting said pressurized can of spray foam into said insulating sleeve, said insulating sleeve having a bottom wall and a perimeter wall extending upwardly from said bottom wall, said perimeter wall having a distal edge with respect to said bottom wall, said cut extending through said perimeter wall, said cut extending from said distal edge toward said bottom wall, said cut having a first bounding edge and a second bounding edge;

an elastomeric band being coupled to and extending around a full circumference of said distal edge of said perimeter wall of said insulating sleeve, said elastomeric band being biased to compress against said pressurized can of spray foam for retaining said pressurized can of spray foam within said insulating sleeve;

a ring being bonded to said insulating sleeve, said ring being comprised of a rigid material thereby facilitating said ring to enhance structural rigidity of said insulating sleeve, said ring extending around a full circumference of said perimeter wall of said insulating sleeve, said ring being positioned adjacent to said bottom wall of said insulating sleeve;

a closure being integrated into said insulating sleeve, said closure being aligned with said cut for opening and closing said cut, said closure comprising a first portion extending along said first bounding edge of said cut, said closure comprising a second portion extending along said second bounding edge of said cut, said first portion engaging said second portion when said closure is manipulated into a closing condition, said first portion disengaging said second portion when said closure is manipulated into an opening condition; and a belt clip being coupled to said insulating sleeve wherein said belt clip is configured to engage an article of clothing on a user for storing said insulating sleeve, said belt clip comprising:

a panel being integrated into said perimeter wall of said insulating sleeve, said panel extending from said ring toward said distal edge of said perimeter wall, said panel having an upper edge, a first lateral edge and a second lateral edge, said upper edge curving upwardly between said first lateral edge and said second lateral edge, each of said first lateral edge and said second lateral edge having a curved portion located adjacent to said ring, said curved portion of each of said first lateral edge and said second lateral edge curving outwardly from a center of said panel; and a member having a first end, a second end and an outer surface extending between said first end and said second end, said outer surface having a first side, said member having a first curve being positioned closer to said first end than said second end to define a first section of said member extending downwardly along a second section of said member, said first end being associated with said first section, said second end being associated with said second section, said first side of said outer surface corresponding to said second section being bonded to said panel having said second section being vertically oriented on said panel, said second end abutting said ring, said member having a second curve being positioned adjacent to said first end such that said first end is directed away from said second section wherein said member is configured to have the article of clothing inserted between said first section and said second section.

* * * * *